US009064489B2

(12) United States Patent
Kaszczuk et al.

(10) Patent No.: US 9,064,489 B2
(45) Date of Patent: Jun. 23, 2015

(54) HYBRID COMPRESSION OF TEXT-TO-SPEECH VOICE DATA

(71) Applicant: IVONA Software Sp. z o.o., Gydnia (PL)

(72) Inventors: Michal T. Kaszczuk, Gdansk (PL); Lukasz M. Osowski, Gdynia (PL)

(73) Assignee: IVONA Software Sp. z o.o., Gydnia (PL)

( * ) Notice: Subject to any disclaimer, the term of this patent is extended or adjusted under 35 U.S.C. 154(b) by 373 days.

(21) Appl. No.: 13/720,900

(22) Filed: Dec. 19, 2012

(65) Prior Publication Data

US 2014/0122060 A1 May 1, 2014

(30) Foreign Application Priority Data

Oct. 26, 2012 (PL) ..... 401372

(51) Int. Cl.

| | |
|---|---|
| ***G10L 13/00*** | (2006.01) |
| ***G10L 25/00*** | (2013.01) |
| ***G10L 13/04*** | (2013.01) |
| *G10L 19/00* | (2013.01) |
| *G10L 21/04* | (2013.01) |

(52) U.S. Cl.

CPC ..... *G10L 13/04* (2013.01); *G10L 19/00* (2013.01); *G10L 21/04* (2013.01)

(58) Field of Classification Search

CPC ... G10L 15/22; G10L 17/22; G10L 2015/223; G10L 13/00; G10L 15/26; G10L 13/027; G10L 13/02; G10L 13/043; G10L 15/08; G10L 13/033; G10L 15/30; G06F 3/167

USPC ..... 704/258, 260, 261, 270, 270.1, 275, 704/277

See application file for complete search history.

(56) References Cited

U.S. PATENT DOCUMENTS

| | | | | |
|---|---|---|---|---|
| 5,873,059 | A * | 2/1999 | Iijima et al. | 704/207 |
| 5,920,840 | A * | 7/1999 | Satyamurti et al. | 704/267 |
| 6,308,156 | B1 * | 10/2001 | Barry et al. | 704/268 |
| 7,454,348 | B1 * | 11/2008 | Kapilow et al. | 704/269 |
| 7,567,896 | B2 * | 7/2009 | Coorman et al. | 704/10 |
| 8,321,222 | B2 * | 11/2012 | Pollet et al. | 704/260 |
| 2003/0004711 | A1 * | 1/2003 | Koishida et al. | 704/223 |
| 2003/0171922 | A1 * | 9/2003 | Beerends et al. | 704/233 |

FOREIGN PATENT DOCUMENTS

WO WO 2011/088053 A2 7/2011

* cited by examiner

*Primary Examiner* — Edgar Guerra-Erazo

(74) *Attorney, Agent, or Firm* — Knobbe, Martens, Olson & Bear, LLP

(57) ABSTRACT

Recorded or synthesized speech segments of text-to-speech (TTS) systems may be compressed though the use of both time domain compression and perceptual compression techniques. The twice-compressed recording may be separated into speech segments corresponding to words or subword units for use in a TTS system. The compression rate of time domain compression, and the ratio of time domain compression to perceptual compression, may be modified for any speech segment. The compression amount or ratio may be determined based on linguistic or acoustic features of the word or subword unit that the speech segment represents. Differing compression amounts and ratios may be applied to portions of a single speech segment.

26 Claims, 6 Drawing Sheets

HYBRID COMPRESSION OF TEXT-TO-SPEECH VOICE DATA

BACKGROUND

Text-to-speech (TTS) systems convert raw text into sound using a process sometimes known as speech synthesis. In a typical implementation, a TTS system first preprocesses raw text input by disambiguating homographs, expanding abbreviations and symbols (e.g., numerals) into words, and the like. The preprocessed text input can be converted into a sequence of words or subword units, such as phonemes or diphones. The resulting sequence of words or subword units is then associated with acoustic features of speech segments, which may be small recorded or synthesized speech files. The phoneme sequence and corresponding acoustic features are used to select and concatenate speech segments into an audio presentation of the input text.

Different voices for a TTS system may be implemented as sets of speech segments and data regarding the association of the speech segments with a sequence of words or subword units. Speech segments can be created by recording a human while the human is reading a script. The recording can then be separated into segments sized to encompass all or part of words or subword units.

TTS systems may be deployed onto a variety of devices, ranging from servers and desktop computers to electronic book readers and mobile phones. In a typical deployment, a TTS engine and voice data for one or more voices may be distributed to the device via a disk or via network download. In some cases, the TTS engine and voice data may be preinstalled on the device.

BRIEF DESCRIPTION OF DRAWINGS

Throughout the drawings, reference numbers may be reused to indicate correspondence between referenced elements. The drawings are provided to illustrate example embodiments described herein and are not intended to limit the scope of the disclosure.

DETAILED DESCRIPTION

Introduction

Figure 1:
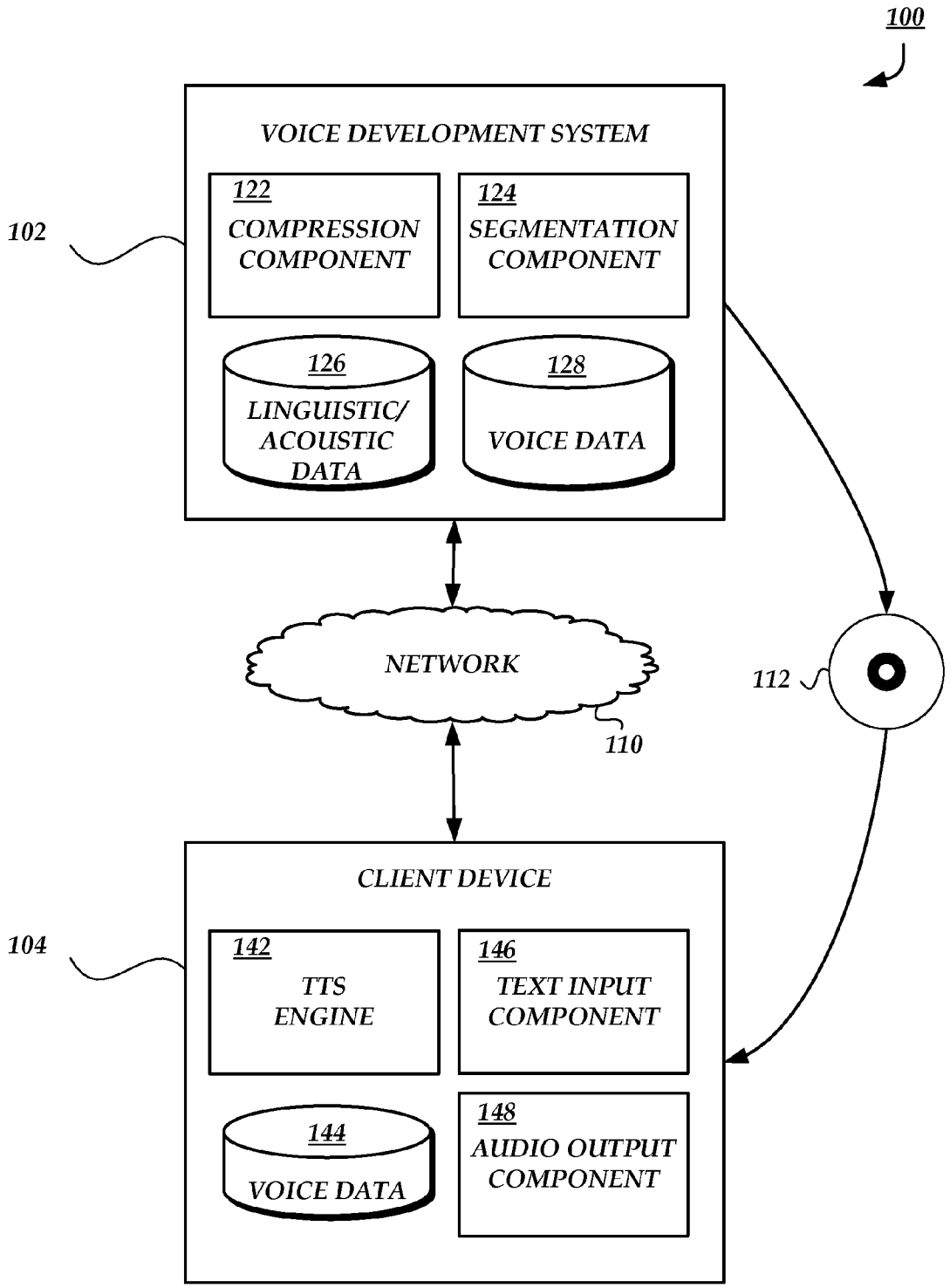
FIG. 1 is a block diagram of an illustrative voice development system configured to develop text-to-speech voices, and a client device configured to utilize the voices.

Generally described, the present disclosure relates to speech synthesis systems. Specifically, aspects of the disclosure relate to compressing recorded or synthesized speech segments though the use of both time domain compression and other compression techniques (e.g., perceptual compression techniques) in order to reduce the amount of storage space required to store a text-to-speech (TTS) voice. A voice talent may be recorded while reading a text. The recording may be compressed using time domain compression. For example, 2× time domain compression may be applied to a voice recording. As a result, the compressed recording may consume ½ the amount of storage space as the original uncompressed voice recording because roughly half of the data of the original recording is preserved. The compressed recording may then be compressed again with a perceptual compression technique which further reduces the file size. The twice-compressed recording may be separated into speech segments corresponding to words or subword units for use in a TTS system.

Additional aspects of the invention relate to modifying the amount of time domain compression and the ratio of time domain compression to perceptual compression that is used for a given speech segment. The compression amount or ratio may be determined based on linguistic or acoustic features of the word or subword unit that the speech segment represents. For example, a voice recording may be separated in to speech segments, and a higher rate of compression may be applied to speech segments of voiced phonemes than unvoiced phonemes. Further aspects of the disclosure relate to applying differing compression amounts and ratios to portions of a single speech segment.

Although aspects of the embodiments described in the disclosure will focus, for the purpose of illustration, on interactions between a voice development system and client computing devices, one skilled in the art will appreciate that the techniques disclosed herein may be applied to any number of hardware or software processes or applications. Further, although the description which follows will use perceptual compression as an example for clarity, other compression techniques may be used as well. Various aspects of the disclosure will now be described with regard to certain examples and embodiments, which are intended to illustrate but not limit the disclosure.

With reference to an illustrative embodiment, a speech synthesis system, such as a TTS system for a language, may be created. The TTS system may include a set of audio clips of word or subword units, such as phonemes or diphones. The audio clips, also known as speech segments, may be portions of a larger recording made of a person reading a text aloud. In some cases, the audio clips may be computer-generated rather than based on portions of a recording. The TTS system may also include linguistic rules that can be used to select and sequence the audio clips based on the text input. The audio clips, when concatenated and played back, produce an audio presentation of the text input.

Mobile devices and other devices with limited storage capacity may implement the TTS system. The storage requirements for uncompressed TTS system components, such as voice data, may exceed 2 gigabytes (GB), which can be a substantial portion of available mobile device storage. Accordingly, the voice data may be compressed through the use of time domain compression. Compression in the time domain increases the amount of recorded material that may be stored in a unit of storage by effectively speeding up the recording. For example, applying 2× time domain compression to a recording will produce a recording that consumes roughly half of the storage space. If the recording were played back without adjusting for the compression, it would play back at roughly twice the speed and in roughly half of the original time.

The compressed speech unit may then be compressed using perceptual compression techniques. A perceptual compression technique can preserve information that is important to human perception of the recorded speech, such as the frequency spectrum of a sound over time, while reducing the amount of less significant information that is present in the uncompressed version.

Audio recordings are typically composed of many samples of data for each second of recording time. Time domain compression may involve reducing the number of samples of data so that the overall recording is compressed into a smaller amount of space. A predetermined amount of time domain compression may be applied to the speech recording prior to the application of perceptual compression. For example, 2× time domain compression may be applied. This may result in reducing the number of samples from the recording approximately by a factor of two, thereby reducing the amount of storage required by about half. Various methods may be used to decompress the time compressed audio, so that the recording may be played back at its original speed. In some cases, 2.5×, 3×, or greater time domain compression may be used. In some cases less compression may be used when the removal of more than a threshold number of samples noticeably affects the quality of the recording on playback of an uncompressed recording. This can occur because it becomes more difficult to accurately reconstruct decompressed audio as the number of samples decreases.

After a speech recording has been compressed using these techniques, it may be separated into speech segments as appropriate for use in a TTS system. For example, a TTS system may utilize diphones, and therefore the compressed speech recording can be separated into diphones and stored in a database. When the TTS system is used to synthesize speech, the speech segments can be decompressed prior to playback.

In some embodiments, the voice recording can be separated into speech segments prior to applying compression, and each speech segment can then be compressed individually or in groups. Separating the voice recordings prior to applying compression can allow the application of different compression settings to each speech segment. The particular compression rate or ratio applied to any given speech segment may be based on linguistic or acoustic characteristics of the speech segment or the subword unit represented by the speech segment. For example, one speech segment that corresponds to a longer and/or uncomplicated sound may be compressed at a relatively high rate of compression (e.g.: time domain compression of 5×, perceptual compression of 95%), while another speech segment that corresponds to a shorter and/or complex sound may be compressed at a lower rate (e.g.: no time domain compression, 50% perceptual compression). Data regarding the type and amount of compression that is applied to each speech segment, or to speech segments of a particular category (e.g.: unvoiced speech units, voiced speech units) may be embedded within the speech segments themselves, distributed with the speech segments, or otherwise made readily available to consumers of the speech segments. When a TTS system subsequently utilizes the speech segments created using these techniques, it may consult the data or be programmed to automatically determine the proper decompression methods and parameters for each speech segment.

Leveraging linguistic and acoustic knowledge of the various speech units to be represented by a speech segment can provide the opportunity to maximize compression where quality is not likely to be affected or storage space is at a premium. Similarly, compression maybe be minimized or completely forgone quality is more important or storage space is readily available.

TTS Voice Development and Distribution Environment

Prior to describing embodiments of a system for compressing TTS system speech segments in detail, an example development and distribution environment in which these features can be implemented will be described. FIG. 1 illustrates a TTS system voice development and distribution environment 100 including a voice development system 102 and a client device 104 in communication via a network 110. In some embodiments, the voice development and distribution environment 100 may include additional or fewer components than those illustrated in FIG. 1. For example, the number of client devices 104 may vary substantially, and the voice development system 102 may communicate with two or more client devices 104 substantially simultaneously.

The network 110 may be a publicly accessible network of linked networks, possibly operated by various distinct parties, such as the Internet. In other embodiments, the network 110 may include a private network, personal area network, local area network, wide area network, cable network, satellite network, etc. or some combination thereof, each with access to and/or from the Internet. In some embodiments, the voice development system 102 does not communicate with a client device 104 via a network 110, but rather distributes TTS system voices via disks 112 or some other method.

The voice development system 102 can include any computing system or group of computing systems, such as a number of server computing devices, desktop computing devices, mainframe computers, and the like. In some embodiments, the voice development system 102 can include several devices or other components physically or logically grouped together. The voice development system 102 illustrated in FIG. 1 includes a compression component 122, a segmentation component 124, linguistic and acoustic data store 126, and a voice data store 128.

The compression component 122 and segmentation component 124 may be implemented on one or more application server computing devices. For example, the compression component 122 may include an application server computing device configured to receive voice recording input in various formats and generate compressed audio output in various formats. The segmentation component 124 may be integrated with or coupled to the compression component 122, or it may be implemented as a separate device. The segmentation component 124 can receive audio input, either compressed or uncompressed, and generate speech segments corresponding to words or subword units that may be stored in the voice data store 128.

The linguistic and acoustic data store 126 may be implemented on a database server computing device configured to store records, audio files, and other data related to the development of a voice for a TTS system. In some embodiments, linguistic and acoustic data is included in a separate component, such as a software program or a group of software programs. The voice data store 128 may be implemented on the same database server or a different database server. The voice data store 128 can be used to store compressed speech segments output from the compression component 122 and the segmentation component 124. The speech segments may be packaged and transmitted to a client device 104 via a network 110, via a disk 112, or through some other technique such as pre-installation.

The client device 104 may correspond to any of a wide variety of computing devices, including personal computing devices, laptop computing devices, hand held computing devices, terminal computing devices, mobile devices (e.g., mobile phones, tablet computing devices, etc.), wireless devices, electronic book readers, media players, and various other electronic devices and appliances. The client device 104 illustrated in FIG. 1 includes a TTS engine 142, a voice data store 144, a text input component 146, and an audio output component 148. As will be appreciated, the client device 104 may include many other components, such as one or more central processing units (CPUs), random access memory (RAM), hard disks, video output components, and the like. In particular, mobile devices such as mobile phones and tablet computers may include a limited amount of internal storage due to the small form factor of the device, cost of storage, and other factors. Moreover, the amount of internal storage available to a TTS system may be limited further by amount of space reserved for operating system components, drivers, and application software that is necessary for the operation of the device or which provide features desired by a user of the device.

The TTS engine 142 may be configured to process input in various formats, such as a document obtained from the text input component 146, and generate audio files or steams of synthesized speech. The voices data store 144 of the client device 104 may correspond to a database configured to store records, audio files, and other data related to the generation of a synthesized speech out from a text input. As described above, the voice data may be received from a voice development system 102 via a network 110, a disk 112, or pre-installation. The text input component 146 can correspond to one or more software programs or purpose-built hardware components. For example, the text input component 146 may be configured to obtain text input from any number of sources, including electronic book reading applications, word processing applications, web browser applications, and the like executing on or in communication with the computing device 104. The audio output component 148 may correspond to any audio output component commonly integrated with or coupled to a computing device 104. For example, the audio output component 148 may include a speaker, headphone jack, or an audio line-out port.

Figure 2:
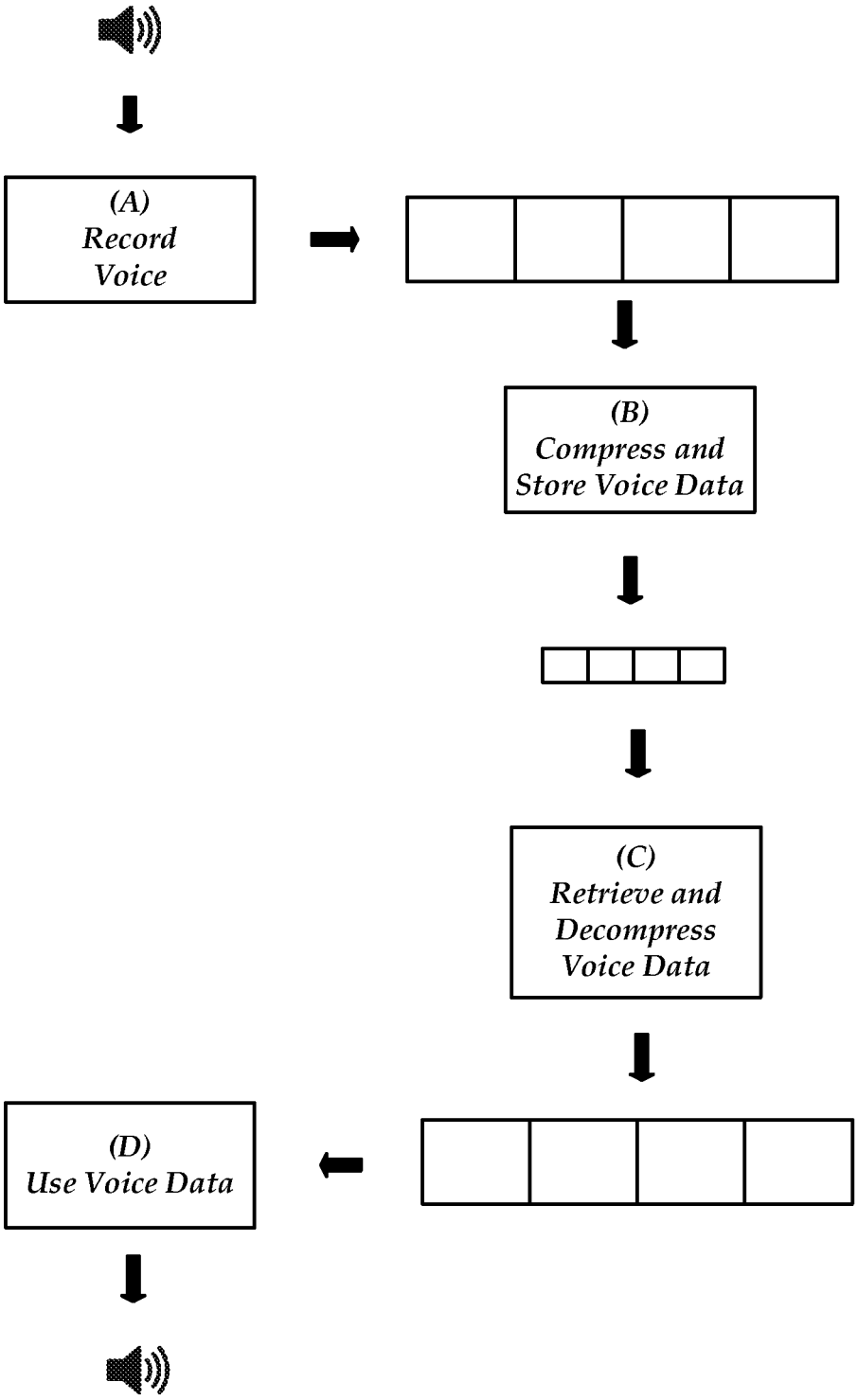
FIG. 2 is a block diagram of an illustrative speech segment at various stages of development, compression, storage, and utilization.

To obtain the voice data, a voice talent may be recorded while reading a script. The script may be chosen because it includes the various words and subword units that will form the basis of the separated speech segments. The voice development system 102 obtains one or more voice recordings and compresses, segments, and stores them for distribution. FIG. 2 illustrates a voice recording at various stages in the compression process. The voice development system 102 obtains one or more voice recordings at (A).

The compression component 122 can compress the voice recording utilizing a combination of time domain compression and perceptual compression at (B). The compression ratios and other compression parameters may be customized for each word or subword unit of the voice recording based on data in the linguistic and acoustic data store 126. The data in the linguistic and acoustic data store main include information about which phonemes, diphones, or other subword units correspond to words, various acoustic features of the subword units, and the like.

The segmentation component 124 can separate the voice recording prior to or subsequent to compression by the compression component 122. The compressed speech segments can be stored in the voice data store 128. In some embodiments, other information is stored in the voice data store 128 with the speech segments, such as information about the compression ratios and other parameters that were used to compress the speech segments or which may be used to decompress the speech segments for playback. The voice data, including speech segments and other information, may be distributed to client devices 104 for use in TTS systems.

The TTS engine 142 of a client device 104 can decompress, concatenate, and play back the speech segments at (C) as an audio presentation of a text input. The speech segments can be decompressed according to predetermined rules and parameters that are programmed into the TTS engine 142 or which the TTS engine 142 otherwise has access to. In some embodiments, as described above, the speech segments may be compressed differently based on linguistic and/or acoustic features of individual segments. In such case, the voice data store 144, which contains the speech segments and other voice data received from the voice development system 102, may include parameters and other data regarding proper decompression of the speech segments.

Generating Compressed Speech Segments

Figure 3:
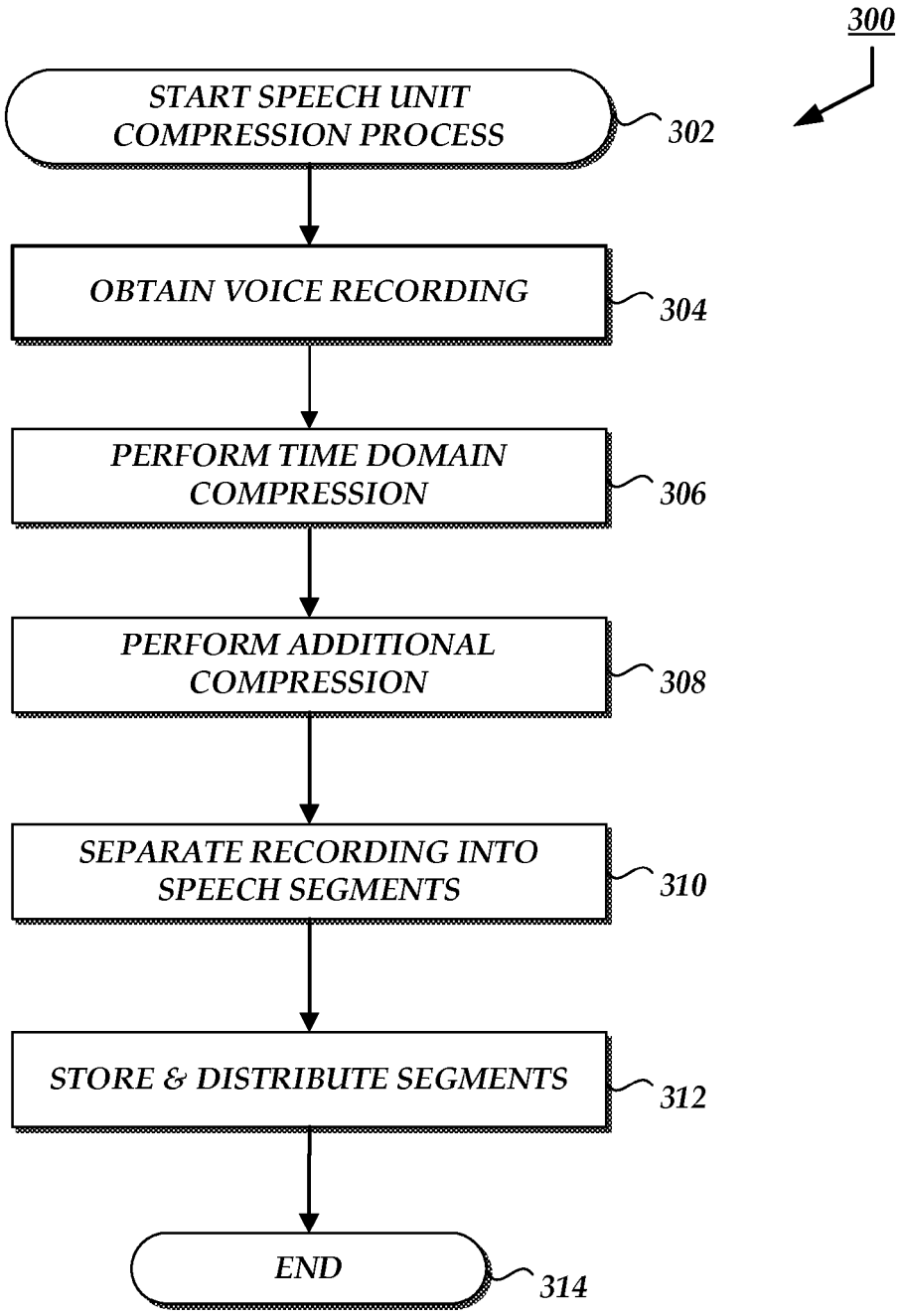
FIG. 3 is a flow diagram of an illustrative process for creating and compressing a set of speech segments for use in a text-to-speech system.

Turning now to FIG. 3, an illustrative process 300 for generating a TTS voice will be described. A TTS system developer may wish to develop a new voice for a previously developed language (e.g., a new male voice for an already released American English product, etc.), or develop an entirely new language (e.g., a new German product will be launched without building on a previously released language and/or voice, etc.). The TTS system developer may record the voice of one or more people. Based on linguistic and acoustic rules and data, the recording may be compressed, segmented, and distributed to users of the TTS system. Advantageously, the recording may be compressed using two different types of compression which each operate in a different domain of the recording. As a result, the size of the file may be smaller than using a single compression technique to achieve the same level of quality, and a higher level of quality may be preserved than using a single compression technique to achieve the same reduction in file size. In addition, a higher level of quality may be preserved than using two compression techniques which operate within the same domain The process 300 of generating a compressed TTS system voice begins at block 302. The process 300 may be executed by a compression component 122 and a segmentation component 124 of a voice development system 102, alone or in conjunction with other components. In some embodiments, the process 300 may be embodied in a set of executable program instructions and stored on a computer-readable medium drive associated with a computing system. When the process 300 is initiated, the executable program instructions can be loaded into memory, such as RAM, and executed by one or more processors of the computing system. In some embodiments, the computing system may encompass multiple computing devices, such as servers, and the process 300 may be executed by multiple servers, serially or in parallel.

At block 304, the voice development system 102 can obtain a voice recording. The voice recording may be an analogue or digital recording obtained from a system or component independent of the voice development system 102, or it may be originally created by or in conjunction with the voice development system 102. If the voice recording is obtained in analogue form, it may be converted to digital form by any technique known to one of skill in the art. For example, the voice recording may be a waveform file created from an audio signal through the use of pulse code modulation (PCM). Waveforms created by PCM capture a substantial portion of the audible aspects of an audio signal plus other data. The process illustrated in FIG. 3 utilizes various techniques to remove data that, judged from the perspective of a human listener, does not correspond to the audible aspects of the original recording, or to approximate data corresponding to audible aspects through the use of data structures and other techniques that consume less storage space.

At block 306, the voice recording may be compressed using time domain compression. Time domain compression (or coding) techniques compress the audible aspects of a recording into a shorter playback period of time than the original, uncompressed recording. A recording that has been compressed in the time domain, such as one that has 2× compression applied to it, may sound twice as fast during playback due to the compression. Accordingly, decompression techniques may be used during playback to expand the compressed recording into its original playback time by approximating or recreating the data that has been removed. Various time domain compression techniques may be used, such as those based on the overlap and add (OLA) family of techniques. For example, a voice recording may be compressed in the time domain by using a Time Domain Pitch Synchronous Overlap and Add (TD-PSOLA) algorithm. A Waveform Similarity Overlap and Add (WSOLA) algorithm may be used to compress the voice recording within the time domain without affecting the pitch.

Figure 4:
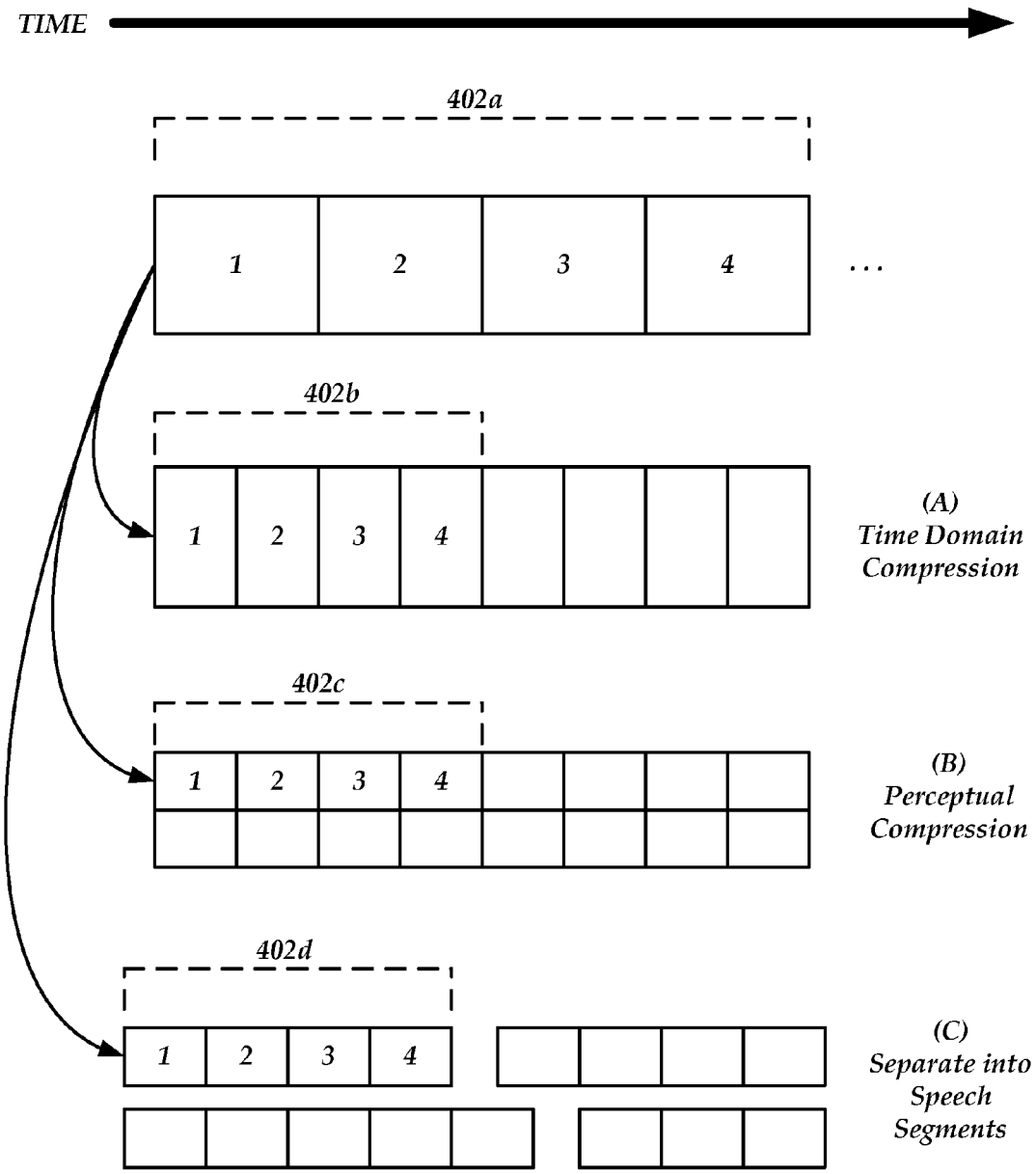
FIG. 4 is a block diagram of an illustrative speech segment at various stages of the process illustrated in FIG. 3.

FIG. 4 illustrates a voice recording at various states of the voice development process. Segment 402*a* of the voice recording, which consists of portions 1-4 of the voice recording (e.g., each portion may represent a period of time, such as 100 milliseconds, or a number of samples, such as 100 samples), is illustrated in uncompressed form. Time domain compression is applied at (A), and as a result segment 402*b* corresponds to roughly half of the playback time of the uncompressed segment 402*a* while containing the same portions 1-4 as the uncompressed segment 402*a*. Typically each portion of data 1-4 in the compressed segment 402*b* contains less data than the corresponding uncompressed portion 1-4 of the original, uncompressed segment 402*a*.

Returning to FIG. 3, at block 308 the compression component 122 can apply additional compression (e.g., perceptual compression or analysis-synthesis coding) to a voice recording that has already been compressed in the time domain, above. For example, perceptual compression (or coding) techniques attempt to preserve those aspects of an audio recording that are important and useful in reproducing the sound of the original recording for a human listener. Aspects that are most important to reproduce the waveform of the original recording, but which may not substantially affect audibility from the perspective of a human listener, may not be preserved. Because a human listener may not discern every feature of an original uncompressed waveform, only those features which are audible to a human listener need to be recreated. As a result, a high quality compressed copy, judged from the perspective of a human listener, may contain different data than a high quality compressed copy, judged from the perspective of reproducing the original waveform.

Various perceptual compression or analysis-synthesis coding techniques may be used. For example, code-excited linear prediction (CELP), algebraic code-excited linear prediction (ACELP), linear predictive coding (LPC), residual excited linear predictive coding (RELPC), Advanced Audio Coding (AAC), Adaptive Multi-Rate Wideband (AMR-WB), and various techniques from the Motion Picture Experts Group (MPEG1-MPEG4) may be applied to a recording that has been compressed in the time domain. In some embodiments, perceptual compression or analysis-synthesis coding is applied prior to time domain compression. For example, a perceptual compression technique such as CELP may be applied to an uncompressed recording, and then time domain compression may be applied to the compressed recording.

As seen in FIG. 4, the portions 1-4 of segment 402*b* have been compressed further through the use of perceptual compression at (B). Segment 402*c* contains the same portions 1-4 as segment 402*b* and uncompressed segment 402*a*. The portions are illustrated in FIG. 4 as being smaller, though, due to the removal and approximation of data contained therein. For example, assuming that 2× time domain compression was applied at (A), and 50% perceptual compression applied at (B), the resulting segment 402*c* consumes only ¼ of the space of the original uncompressed recording 402*a*.

At block 310 of the process 300 illustrated in FIG. 3, the compressed recording may be separated into speech segments. Separation of speech segments may include recording position data regarding the position of each speech segment within the compressed recording. Such data can be used later to locate a speech segment within the recording. Linguistic and acoustic data may be used to separate the recording into desired speech segments. For example, the compressed recording may be separated into words or subword units, such as phonemes. In some embodiments, it may be desirable to use diphones as the recorded speech segment. Diphones can encompass some or all of two consecutive phonemes and the transition between the two consecutive phonemes. For example, the word "bat" begins with a /b/ phoneme followed by an /ae/ phoneme and finishes with a /t/ phoneme. A voice development may wish to create speech segments corresponding to instances of the /b/+/ae/ diphone and the /ae/+/t/ diphone, among others. The actual number of desired diphones (or other subword units, or entire words) may be quite large, and several instances of each diphone, in similar contexts and in a variety of different contexts, may be recorded, compressed, and separated for use as speech segments in a TTS system.

FIG. 4 illustrates the separation of the original recording into speech segments at (C). As shown in FIG. 4, segment 402*c* has been separated from the rest of the recording. For example, data portions 1-4 may correspond to the /b/+/ae/ diphone from the word "bat," while the next four portions of data may correspond to the /ae/+/t/ diphone that concludes the word. By separating portions 1-4 into an independent speech segment 402*d*, the segment 402*d* can be concatenated with other diphones separated from other words in order to produce an audio presentation of a different word altogether, for example as is done in unit-selection-based TTS systems.

At block 312 of the process 300 illustrated in FIG. 3, the individual speech segments may be stored and distributed. For example, the segments may be stored in a voice data store 128 of the voice development system 102, and later transmitted to one or more client devices 104 via a network 110, disk 112, or some other distribution medium or method. As described above, position data indicating the position of speech segments within a compressed recording may be stored. In such cases, distributing the speech segments can include distributing a compressed recording that contains multiple speech segments, and also distributing position data that can be used to locate each speech segments within the compressed recording.

Compression Based on Linguistic or Acoustic Features

Figure 5:
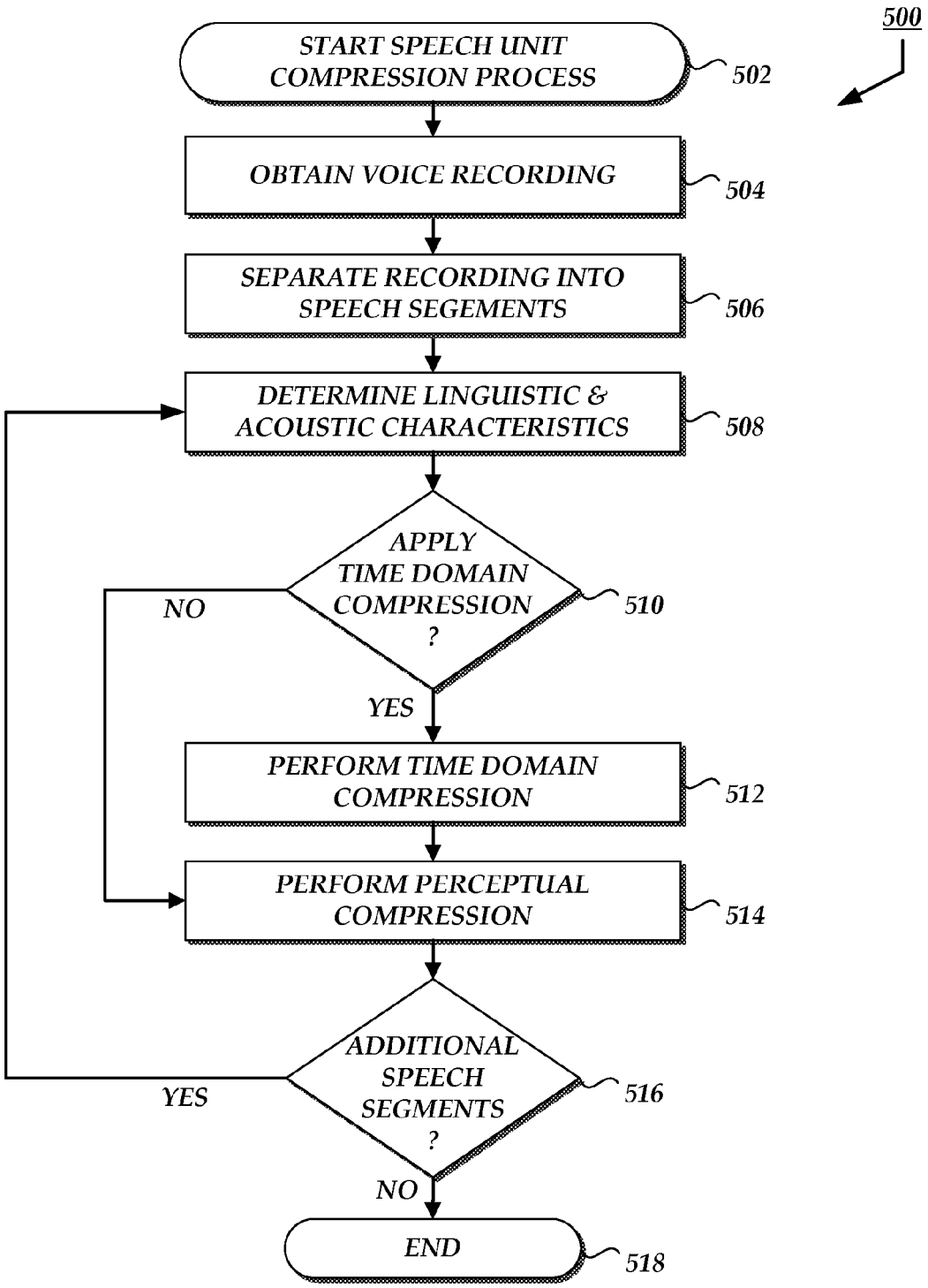
FIG. 5 is a flow diagram of an illustrative process for creating and compressing a set of speech segments for use in a text-to-speech system.

Turning now to FIG. 5, another illustrative process 500 for generating a TTS voice will be described. A TTS system developer may wish to develop a voice with higher compression than used in the process 300 described above, but a further loss in quality may be unacceptable. Due to the linguistic or acoustic features of some words or subword units, the corresponding speech segments may be compressed at a higher rate than others without experiencing loss in quality. By determining compression rates and techniques for individual speech segments, the linguistic and acoustic features associated with the word or subword unit corresponding to the speech segment may be considered. Advantageously, this provides a greater savings in storage space utilization for those speech segments than may otherwise be possible without affecting the quality of other speech segments.

The process 500 of generating individually compressed speech segments begins at block 502. The process 500 may be executed by a compression component 122 and a segmentation component 124 of a voice development system 102, alone or in conjunction with other components. In some embodiments, the process 500 may be embodied in a set of executable program instructions and stored on a computer-readable medium drive associated with a computing system. When the process 500 is initiated, the executable program instructions can be loaded into memory, such as RAM, and executed by one or more processors of the computing system. In some embodiments, the computing system may encompass multiple computing devices, such as servers, and the process 500 may be executed by multiple servers, serially or in parallel.

Figure 6:
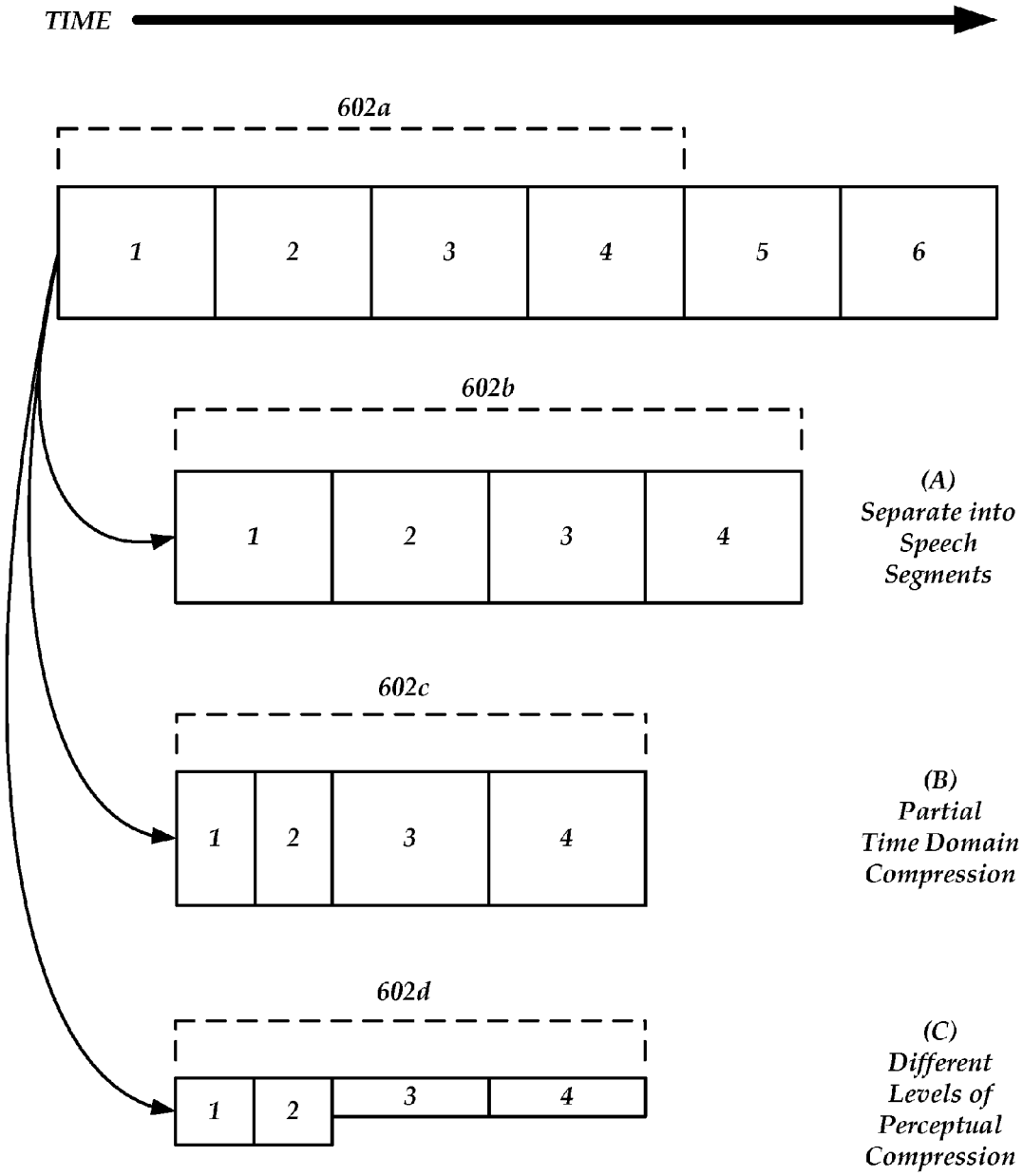
FIG. 6 is a block diagram of an illustrative speech segment at various stages of the process illustrated in FIG. 5.

At block 504, a voice recording may be obtained, similar to the process 300 described above with respect to FIG. 3. At block 506, the segmentation component 124 can separate the voice recording into speech segments. As described above, a speech segment may correspond to a diphone or some other subword unit, or to a word or group of words. FIG. 6 illustrates a voice recording at various stages of the process 500. The segment 602*a*, consisting of data portions 1-4, can be separated from the original recording into an independent speech segment 602*b* at (A).

At block 508 of the process 500 illustrated in FIG. 5, the compression component 122 can begin to compress individual speech segments. First, the compression component 122 can determine linguistic and acoustic features of the current speech segment. The linguistic and acoustic features may be used to select a compression amount, ratio, or technique to apply to the speech segment. The linguistic and acoustic features of interest may include phonetic context, stress level, part of speech, intonation, prosody models, whether a unit is voiced or unvoiced, and the like.

For example, linguistic data may be used to identify plosive phonemes. Plosive phonemes (e.g.: /t/, /p/) include two different types of sounds: a plosive portion occurring at the instant that air is released from a speaker's mouth, and more silent portion after the plosive release of air. Time domain compression may not be appropriate for speech segments corresponding to this type of subword unit because the primary sound feature of the phoneme occurs in a short period of time (e.g.: the instant that air is released). Removing any portion of that time period may degrade the quality of the speech segment. Therefore in some embodiments, time domain compression may be used sparingly or not at all for speech segments that contain a plosive feature. In contrast, some long vowel sounds (e.g.: /E/ in the word "feet") have a consistent acoustic profile for an extended period of time. Speech segments corresponding to these sounds may experience little or no loss in quality from time domain compression, even at levels above 2× or 3×. Therefore in some embodiments, time domain compression may be used at relatively high levels for speech segments that feature a long vowel sound.

Acoustic data may be used to identify additional characteristics of speech segments to consider when determining an appropriate type or amount of compression. Some acoustic characteristics may be associated with an unacceptable degradation in quality under even moderate levels of compression. Other acoustic characteristics may withstand higher levels of compression, different types of compression, etc. For example, data regarding acoustic features of sounds and subword units may be used to identify voiced and unvoiced sounds that may be included in a speech segment. Unvoiced sounds (e.g.: /s/) do not have a voiced part of the signal. Application of high compression levels to unvoiced sounds may not degrade the quality of the sounds as much as it degrades the quality of voiced sounds (e.g.: long vowel sounds such as /E/).

In some cases, the quality of some sounds is not degraded by certain types of compression (certain time domain compression techniques for long vowel sounds, certain perceptual compression techniques for plosive sounds) while other types of compression may substantially degrade the quality of the same speech segment (certain perceptual compression techniques for long vowel sounds, certain time domain compression techniques for plosives). Accordingly, the ratio of time domain compression to perceptual compression may vary from speech segment to speech segment. In some embodiments, different types and levels of compression may be applied to different portions of a single speech segment.

At decision block 510, the compression component 122 can determine whether to apply time domain compression to the current speech segment. If time domain compression is to be applied, the process 500 may proceed to block 512. Otherwise, the process 500 may resume at block 514.

At block 512, the compression component 122 can apply time domain compression to the current speech segment. As described above, the amount of time domain compression may be customized based on linguistic and acoustic features of the sound or subword unit contained in the speech segment. As a result, there may be a range of time domain compression amounts and ratios applied to speech segments that make up a single voice. Information about the compression used for a given speech segment may be embedded into the speech segment itself, or may be stored with the speech segments, for example in a database table; or may be derived from linguistic/acoustic features. Such information may be necessary in order for the speech segment to be appropriately decompressed for use by a TTS system on a client device 104.

In some cases the speech segments correspond to diphones, which encompass at least a portion of two adjacent phonemes in a word. Accordingly, there may be diphones that include a portion of one phoneme which retains an acceptable degree of quality under relatively high compression, and a portion of a second phoneme which experiences unacceptable degradation even under relatively low level of compression, such as time domain compression. In such cases, the compression component 122 may choose the highest level of compression that is acceptable for each portion of the speech segment, which may correspond to the single lowest preferred compression rate for any portion of the speech segment. For example, in implementations that do not utilize time domain compression for plosive sounds, time domain compression may be forgone for the speech segment as a whole. In some embodiments, portions of the speech segment may be compressed at different rates. Such variable compression may be applied to a single speech segment such that the portion corresponding to the plosive sound is not compressed in the time domain, while the portion that corresponds to a long vowel sound is compressed in the time domain.

FIG. 6 illustrates the speech segment 602*c* partially compressed in the time domain at (B). The first two portions of data 1-2 are compressed in the time domain 2×, while the portions 3-4 remain uncompressed. In this example, the segment 602*c* may represent a diphone. Portions 1-2 may correspond to a long vowel sound, while portions 3-4 may correspond to a plosive.

At block 514 of the process 500 illustrated in FIG. 5, the compression component 122 can apply perceptual compression to the current speech segment. As described above, the amount of perceptual compression may be customized for each speech segment and for different portions of a single speech segment based on the linguistic and acoustic characteristics of the unit of speech represented by the speech segment or each portion thereof. As seen in FIG. 6, different levels of perceptual compression have been applied to the speech segment 602*d* at (C). Portions 1-2, which correspond to a long vowel sound in the example above, have been compressed only slightly because they correspond to a voiced sound. Portions 3-4 have been compressed to a greater degree because, in the example above, they correspond to a plosive sound.

At decision block 514 of the process 500 illustrated in FIG. 5, the voice development system 102 can determine whether there are additional speech segments. If there are additional speech segments to compress, the process 500 can return to block 508 until each speech segment is compressed. Otherwise, the process 500 terminates at block 518.

Terminology

Depending on the embodiment, certain acts, events, or functions of any of the processes or algorithms described herein can be performed in a different sequence, can be added, merged, or left out all together (e.g., not all described operations or events are necessary for the practice of the algorithm). Moreover, in certain embodiments, operations or events can be performed concurrently, e.g., through multi-threaded processing, interrupt processing, or multiple processors or processor cores or on other parallel architectures, rather than sequentially.

The various illustrative logical blocks, modules, routines, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

The steps of a method, process, routine, or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of a non-transitory computer-readable storage medium. An exemplary storage medium can be coupled to the processor such that the processor can read information from, and write information to, the storage medium. In the alternative, the storage medium can be integral to the processor. The processor and the storage medium can reside in an ASIC. The ASIC can reside in a user terminal. In the alternative, the processor and the storage medium can reside as discrete components in a user terminal.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y and Z," unless specifically stated otherwise, is to be understood with the context as used in general to convey that an item, term, etc. may be either X, Y, or Z, or a combination thereof. Thus, such conjunctive language is not generally intended to imply that certain embodiments require at least one of X, at least one of Y and at least one of Z to each be present.

While the above detailed description has shown, described, and pointed out novel features as applied to various embodiments, it can be understood that various omissions, substitutions, and changes in the form and details of the devices or algorithms illustrated can be made without departing from the spirit of the disclosure. As can be recognized, certain embodiments of the inventions described herein can be embodied within a form that does not provide all of the features and benefits set forth herein, as some features can be used or practiced separately from others. The scope of certain inventions disclosed herein is indicated by the appended claims rather than by the foregoing description. All changes which come within the meaning and range of equivalency of the claims are to be embraced within their scope.

What is claimed is:

1. A system comprising:

one or more processors;

a computer-readable memory; and a module comprising executable instructions stored in the computer-readable memory, the module, when executed by the one or more processors, configured to:

obtain a voice recording and a corresponding sequence of speech units;

select a first speech segment, wherein the first speech segment corresponds to a portion of the voice recording and wherein the first speech segment corresponds to a first speech unit;

apply a first compression technique to the first speech segment to create a first compressed speech segment, wherein the first compression technique comprises one of time domain compression or perceptual compression;

apply a second compression technique to the first compressed speech segment to create a second compressed speech segment, wherein the second compression technique comprises one of time domain compression or perceptual compression, and wherein the second compression technique is different from the first compression technique;

distribute the second compressed speech segment to a client computing device for use in a text-to-speech system.

2. The system of claim 1, wherein time domain compression is based at least in part on Time Domain Pitch Synchronous Overlap and Add (TD-PSOLA) compression or Waveform Similarity Overlap and Add (WSOLA) compression.

3. The system of claim 1, wherein perceptual compression is based at least in part on Code-Excited Linear Prediction (CELP), Algebraic Code-Excited Linear Prediction (ACELP), Linear Predictive Coding (LPC), or Residual Excited Linear Predictive Coding (RELPC).

4. The system of claim 1, wherein the first speech unit comprises one of a diphone, a phoneme, or a triphone.

5. The system of claim 1, wherein the first compression technique is time domain compression and a compression rate is based at least in part on the speech unit.

6. A computer-implemented method comprising:

applying, by a text-to-speech voice development system comprising one or more computing devices, a first compression technique to a portion of a voice recording to create a first compressed portion; and applying, by the voice development system, a second compression technique to the first compressed portion to create a second compressed portion;

wherein the second compression technique is different from the first compression technique, and wherein at least one of the first compression technique or the second compression technique comprises time-domain compression.

7. The computer-implemented method of claim 6, wherein time domain compression is based at least in part on Time Domain Pitch Synchronous Overlap and Add (TD-PSOLA) compression or Waveform Similarity Overlap and Add (WSOLA) compression.

8. The computer-implemented method of claim 6, wherein at least one of the first compression technique or the second compression technique is based at least in part on Code-Excited Linear Prediction (CELP), Algebraic Code-Excited Linear Prediction (ACELP), Linear Predictive Coding (LPC), or Residual Excited Linear Predictive Coding (RELPC).

9. The computer-implemented method of claim 6, further comprising storing position data regarding a position of a first speech segment within the second compressed portion based at least in part on a text associated with the voice recording.

10. The computer-implemented method of claim 6, wherein the portion corresponds to one of a phoneme, a diphone, or a word.

11. The computer-implemented method of claim 6, wherein applying the first compression technique comprises applying a different level of time domain compression to a first subportion and a second subportion of the portion.

12. The computer-implemented method of claim 11, wherein the first sub portion corresponds to one of a phoneme, a diphone, or a word.

13. The computer-implemented method of claim 6, further comprising determining a level of compression to apply to the portion based at least in part on a linguistic feature of a text corresponding to the portion.

14. The computer-implemented method of claim 13, wherein the linguistic feature comprises an identification of a phoneme.

15. The computer-implemented method of claim 13 wherein the linguistic feature comprises an indication of a phoneme class, wherein the phoneme class is one of a voiced phoneme, an unvoiced phoneme, a plosive, a vowel, a consonant, a liquid, or a fricative.

16. The computer-implemented method of claim 6, wherein applying the first compression technique comprises applying a different level of compression to a first subportion and a second subportion of the portion.

17. The computer-implemented method of claim 6, further comprising determining a level of compression to apply to the first compressed portion based at least in part on a linguistic feature of a text corresponding to the portion.

18. The computer-implemented method of claim 17, wherein the linguistic feature comprises an identification of a phoneme.

19. The computer-implemented method of claim 17 wherein the acoustic feature comprises an indication of a phoneme class, wherein the phoneme class is one of a voiced phoneme, an unvoiced phoneme, a plosive, a vowel, a consonant, a liquid, or a fricative.

20. A non-transitory computer readable medium which stores a text-to-speech component comprising executable code that directs a client computing device to perform a process comprising:

receiving text comprising a sequence of words; and assembling an audio presentation corresponding to the text, the audio presentation comprising a sequence of speech segments, wherein the sequence of speech segments is based at least in part on the sequence of words, and wherein assembling the audio presentation comprises:

retrieving a first compressed speech segment;

applying two decompression techniques to the first compressed speech segment to obtain a first speech segment;

retrieving a second compressed speech segment;

applying two decompression techniques to the second compressed speech segment to obtain a second speech segment;

concatenating the first speech segment and the second speech segment.

21. The non-transitory computer readable medium of claim 20, wherein the first speech segment corresponds to a word or subword unit.

22. The non-transitory computer readable medium of claim 21, wherein a subword unit comprises one of a phoneme or diphone.

23. The non-transitory computer readable medium of claim 20, wherein applying two decompression techniques to the first compressed speech segment comprises determining a level of time domain compression applied to the first compressed speech segment.

24. The non-transitory computer readable medium of claim 23, wherein determining the level of time domain compression comprises one of querying a database or inspecting metadata associated with the first compressed speech segment.

25. The non-transitory computer readable medium of claim 20, wherein applying two decompression techniques to the first compressed speech segment comprises determining a level of perceptual compression applied to the first compressed speech segment.

26. The non-transitory computer readable medium of claim 25, wherein determining the level of perceptual compression comprises one of querying a database or inspecting metadata associated with the first speech segment.

* * * * *